US005497884A

United States Patent [19]

DeMatteis et al.

[11] Patent Number: 5,497,884

[45] Date of Patent: *Mar. 12, 1996

[54] SELF OPENING DUAL TAB MERCHANDISING BAG

[75] Inventors: Robert B. DeMatteis, Colton; Ralph E. Schlender, Highland, both of Calif.

[73] Assignee: Polytec Packaging, La Mirada, Calif.

[ * ] Notice: The term of this patent shall not extend beyond the expiration date of Pat. No. 5,248,040.

[21] Appl. No.: 126,472

[22] Filed: Sep. 24, 1993

Related U.S. Application Data

[62] Division of Ser. No. 776,920, Oct. 15, 1991, Pat. No. 5,248,040.

[51] Int. Cl.[6] ..... B65D 27/10

[52] U.S. Cl. ..... 206/554; 383/209

[58] Field of Search ..... 206/554; 229/237; 383/9, 120, 209, 35, 37

[56] References Cited

U.S. PATENT DOCUMENTS

| | | | |
|---|---|---|---|
| 3,522,907 | 8/1970 | Utterback, Jr. | 229/237 X |
| 4,480,750 | 11/1984 | Dancy | 206/554 |
| 4,562,925 | 1/1986 | Pistner | 206/554 |
| 4,811,417 | 3/1989 | Prince et al. | 206/554 X |
| 4,903,839 | 2/1990 | Mattiebe et al. | 383/9 X |
| 4,989,732 | 2/1991 | Smith | 206/554 |
| 5,013,290 | 5/1991 | DeMatteis | 383/109 X |
| 5,183,158 | 2/1993 | Boyd et al. | 206/554 |
| 5,248,040 | 9/1993 | DeMatteis et al. . | |

*Primary Examiner*—Allan N. Shoap

*Assistant Examiner*—Christopher J. McDonald

*Attorney, Agent, or Firm*—Townsend and Townsend and Crew

[57] ABSTRACT

In a packet containing a plurality of dual tab merchandising bags, each bag includes a front panel, a rear panel, each side of said bag between the front and rear panels including, a front gusset folded from the front panel, a rear gusset folded from the rear panel, the front and rear gussets joined at a common gusset fold to form an endless tube of bag material around the periphery of said bag. The bags are sealed and severed at the bottom and open and severed at the top, and collapsed and folded one on another so that said gusset sides are folded upon themselves and collapsed under and between the bag front and rear panels. Handle holes are provided centrally of said front and rear panels adjacent said open top of the bag. Tabs are adjacent the sides of the bags at the top of the bag, the tabs having a first portion overlying the gussets and a second portion overlying the central portion of the bag between the gussets, these tabs fused together to form said packet of bags. The tabs are formed from side and center projections, the side projections defined over the front panel, the front gusset, the rear gusset and the rear panel. The center projections are defined over the front panel and the rear panel. Each projections is formed by paired cuts separating the body of the bag from tabs, the cuts being arcuate and spaced apart one from another at their respective ends to form between the tabs and the body of the bag severed borders that point away from the body of the bag and to or toward the material of the tab. The cuts define there between a small and unsevered section of bag material left in place to form the material bridge which joins the body of the bag to the tab until the bag is severed.

13 Claims, 5 Drawing Sheets

SELF OPENING DUAL TAB MERCHANDISING BAG

This is a division of application Ser. No. 07/776,920 filed Oct. 15, 1991, now U.S. Pat. No. 5,248,040.

This invention relates to so-called dual tab merchandising bags. Specifically, a self opening dual tab merchandising bag is disclosed which is capable of being dispensed to an open position with a simple grasping and pulling motion of a clerks arm and hand at a single upwardly exposed bag wall.

BACKGROUND OF THE INVENTION

So-called dual tab merchandising bags are known. Such bags include a front panel, and a rear panel, these panels occupying the full dimension and width of the bag. The front and rear panels are joined by folded front and rear gussets (sides) therebetween. The bags are sealed at the bottom and open at the top. Before the bag is opened, the front and rear gussets are folded at a central gusset fold upon themselves and collapsed under and between the bag front and rear panels.

When the bag is in the collapsed position, the folded gussets only extend partially the width of the front and rear panels of the bag. Thus if the bag in the collapsed position is observed near the side edge, the bag will be found to have four overlying layers. These layers will include, the front panel, the front gusset, the rear gusset, and finally the rear panel. If however, the bag in the collapsed position is observed in the center, the bag will be found to have two overlying layers. These layers will only be the front and rear panels.

In the dual tab merchandising bag, handle holes are provided centrally of the front and rear panels adjacent the top of the bag. Typically the holes are round, registered over one another, and enable support from the front and rear panels to permit merchandise to be carried in the bag when the bag is grasped and held at the handles.

The so-called "dual tabs" of such merchandising bags are observed when the bag is in the collapsed disposition in a so-called "packet" of bags. (It will be understood that the term "wicket" is sometimes also used, particularly by those intimately involved in the bag industry.) These tabs can be found adjacent the sides overlying the bag gussets. The tabs of many bags are fused together to form the packet of bags. The packet of bags is commonly the unitary mass that is manufactured at the same time and taken as a unit to the clerks counter at the same time for serial dispensing—one at a time.

The tabs usually include a common hole through the center of the bags from which the bags as a group can be held. Typically, perforations are used between the body of the bags and the tabs as the separation point between the bag and its associated tabs. When an individual bag is separated from a group of such bags, separation occurs leaving the tabs behind.

Typically, these bags are serially dispensed from the packet of such bags. Consideration of the conventional manner of the dispensing of the bags must be reviewed in detail. This detail is necessary to understand both the construction and convenience of the disclosed new bag set forth herein.

Presuming that a store clerk has made a sale, and is ready to "bag" the purchase of the customer, the steps in placing merchandise within a bag can be serially understood.

First, the clerk reaches for a bag under a counter. The bag is usually contained in a packet of identical bags as vended from the manufacturer. Most commonly the packet of bags are in a dispensing carton. Usually, the bottom sealed seam of the bag is outwardly disposed to the clerk so that the bag may be singulated from the group of remaining bags in the bag packet.

Once the bag is grabbed at the bottom seam, and singulated from the remaining bags, it is pulled outwardly from the containing carton bottom end first so that the open end is away from the grasping hand of the clerk.

At this point, the clerk must grasp the open end of the bag and release the sealed bottom end of the bag. Thereafter, the grasped open end must be taken between the fingers at the open end and the front bag panel separated from the rear bag panel.

This is not an easy task. Specifically, the front and rear panels of the bag have been together since the bag was manufactured; these panels will be held together by both electrostatic forces and the memory of the plastic material. As a consequence, the front and rear panels will attempt to retain their original disposition (as anyone who has ever attempted to open a plastic bag knows). Typically, the front and rear panels will be separated for a sufficient period of time to enable the clerk to individually grasp each panel.

Presuming that the clerk has effected initial opening of the bag, an arm will be inserted to the bag to "find" the bag bottom. This movement effects complete bag opening and enables the front and rear panel to be permanently separated to a sufficient extent that when the purchased merchandise is registered to the opening of the bag, it can slide and otherwise fit inside the bag.

Having set forth serially the discrete steps of the clerk in the opening of conventional merchandise bags, some comments can be offered.

Sometimes dispensing of a bag is unsuccessful. For example, the clerk can often be unsuccessful in the singulation of bags, one from another. Most commonly, more than one bag is grabbed at a time.

When this occurs, the clerk usually immediately separates one bag and proceeds through the necessary steps for the "bagging" of the customer purchase. From the standpoint of the store, the real question is what does the clerk do with the unsuccessfully separated bags?

The unsuccessfully separated bags are usually out of their original planar alignment and withdrawn from their containing carton. That is to say—they are a crumpled mess. The clerk can either smooth out the bags and restore them to the stack of bags for use with the next purchase (a time consuming process when threading of the bags to a containing carton must occur) or the clerk can discard the bags (the more common occurrence). Sometimes, and because the clerk does not want to be directly observed "wasting" brand new bags, the clerk stuffs the unsuccessfully singulated and crumpled bags under the counter. Bags are retained—stuffed and crumpled in a remote volume under the counter—until they are cleaned out as a group and discarded.

Further, the manual opening of the merchandise bags described is distracting—especially to the clerk. During the bag opening process, the clerk's attention is diverted from the customer and the merchandise. Full attention must be devoted to the bag.

The reader will understand that the foregoing discussion is based upon real observations that have been necessary for producing the bag product of this invention.

SUMMARY OF THE PRIOR ART

Self opening so-called T-shirt bags are known. See my previously issued DeMatteis U.S. Pat. No. 5,013,290 issued May 7, 1991 entitled Serially Dispensed Bags Which Open Automatically. In this disclosure, serially dispensed T-shirt bags are dispensed from a rack having paired, outwardly protruding handles. The bags are suspended on, pulled from and assisted in singulation and opening by the rack. Further, once a bag is opened, it is maintained by the rack in an open position so that items purchased by the customer may be place within the bag.

The bag disclosed is for grocery purposes—where the large and open counter areas can accommodate the dispensing rack. It will be understood by those having familiarity with the retail industry that the large dispensing racks and the associated T-shirt bags used with such racks are not suitable in the non grocery retail merchandising industry.

This '290 patent disclosure uses an important principle. The plastic from which the bags are manufactured includes co-extruded bag wall material. This material uses a dull finished high density and strong material on the inside of the bag with a low density and shiny exterior surface on the exterior of the bag. The extruded material on the outside of the bag has a relatively high coefficient of friction; the extruded layer on the inside of the bag has a low coefficient of friction. These differential coefficients of friction are utilized to assist the bags in their serial dispensing and self opening.

The bags depend through holes in the bag handles. These holes in turn have defined "flaps" (dog-eared-like extensions of plastic) situated on the handles at the holes. The holes are threaded through the horizontally extending arms protruding outwardly from the dispensing rack. Design of the flaps in the bag handles with respect to the horizontal arms is made so that substantially the full weight of the arm suspended packet of bags bears down on the flaps.

It will be remembered that the inside surfaces of the bag have a low coefficient of friction and the outside surfaces of the bag have a high coefficient of friction when moved relative to one another. By the expedient of using the low coefficient of friction on the inside of the bag, the flaps cause opening between relatively slippery (low coefficient of friction) flaps to open a bag. By the expedient of using the high coefficient of friction on the outside of the bag, the flaps cause a trailing bag to serially follow and be opened in the path of a bag being removed from the rack.

The disclosure does not suggest or set forth dual tab merchandising bags nor the problems particular to their being both dispensed or opened. Further, the rack utilized necessarily for the opening of the bags is unsuitable in the general merchandising environment.

A dual tab merchandise bag is disclosed in DeMatteis U.S. Pat. No. 4,759,639 entitled Thermoplastic Bag. In this bag, a bag side or gusset construction is set forth which resists tearing at the gussets of the bag. Specifically, the bag sides include upwardly directed "scallops". These upwardly directed scallops are used at the bag sides or gussets to prevent linear or "zipper" like tears from propagating down the side of the bag.

The disclosed bag includes convention "tabs" located on the bag corners when the bag is collapsed to a convention packet of similar bags. Separation of the bag from the packet occurs leaving the tab behind. This separation occurs at a break in the material defined by conventional perforations. Conventional perforations comprise a separation border defined by linearly aligned and arrayed intermittent line cuts through the plastic material separated by small patches of material left intact. When separation occurs, the intact material tears between the intermittent line cuts to define the separation border.

As related to this disclosure, it will be understood that scallops are not required with the co-extruded material here utilized. Further, the use of convention perforations in the vicinity of bag gussets cannot be utilized as tearing of the bag at the gusset seam can occur. This will be made more clear in the disclosure that follows.

SUMMARY OF THE INVENTION

A dual tab merchandising bag is disclosed which is capable of being serially dispensed and opened with a single grasping movement of a clerk's arm at the handle opening of the bag front wall. The function of the bag to effect the serial opening can be best understood by first understanding the improved construction of the bag tabs and thereafter reviewing the serial dispensing of the bags from a bundle of commonly manufactured bags and the interaction of the improved tabs in assisting bag opening.

The tabs here utilized are connected to the body of the bag by two so-called projections or "tits." These projections are each formed by paired cuts separating the body of the bag from tabs. The cuts are arcuate and spaced apart one from another at their respective ends. The arcuate cuts form between the tabs and the body of the bag severed borders that point away from the body of the bag and to or toward the material of the tab.

Between the cuts, a small and unsevered section of bag material is allowed to remain. This small unsevered portion of bag material is left in place when the bag is formed, and is the material bridge which joins the body of the bag to the tab until the bag is severed.

Each tab has a border defined from the bag body by three arcuate cuts. The first arcuate cut is from the bag side to the tip of the tab side projection. The second arcuate cut begins the tab side projection and extends to the tab central projection. The third arcuate cut begins at the central arcuate projection and terminates at the bag top. Thus it will be understood that the first and second arcuate cuts, and the second and third arcuate cuts define small areas of unsevered material that form the points of attachment of the tabs to the bag body. Further, the arcuate cuts end at the projections so as to define two upwardly concave borders that almost meet, these upwardly concave borders being disposed towards the material of the tab to define on the material of the bag the "tit" or projection.

When severance of the body of the bag from the tab occurs, the points of the projections or tits tear away at the tabs. Such tearing propagates the force of severance into the body of the tabs. Propagated "zipper"—like tearing can only occur at the tabs—it cannot occur into the body of the bag.

Two projections or tits hold each tab to the body of the bag. One side projection overlies gusset sides of the bag. Thus the side projection formed connects the four layers at the side of the bag to four tab layers. The layers of the bag connected by side projection includes the front panel, the front gusset, the rear gusset, and finally the rear panel.

A centrally disposed projection overlies the more central portion of the bag. It is placed at a location where it does not conflict with the gusset sides of the bag. Thus this centrally disposed projection connects two layers at the center portion of the bag. The layers of the bag connected by the central gusset projection are the front panel and the rear panel.

The tabs of overlying and similar bags are fused together. They define a common central aperture. This aperture forms the point of suspension of the bags.

The projections are spaced so as not to vertically underlie the common aperture of the tabs. This vertical spacing is measured relative to the "tear" direction of the material. This disposition enables packets of bags improperly cut to be immediately located. This location is made possible by the tab becoming a pendulously held mass attached only at one tab; recycling of the defective bag packet can immediately occur.

It will be understood that the tab on one side of the bag is symmetrical with the tab on the opposite side of the bag. Thus, the description of one tab at one side of the bag, likewise serves to describe the other tab at the other side of the bag. Similarly, and in the description of the tabs interacting with the self opening function of the disclosed bag, the discussion of the operation of one tab at one side of the bag will set forth the symmetrical and simultaneously occurring operation of the tab at the other side of the bag.

Before dispensing occurs, the packet of bags are usually disposed at their upper open end on a flat surface, although this is not required. The flat surface includes two upwardly disposed stanchions. One of these stanchions is threaded through the common aperture of one bag tab of the packet; the other stanchion is threaded through the common aperture of the remaining bag tab of the packet. The stanchions are spaced apart so that the material of the bags in the packet lies flat between the stanchions.

For optimum dispensing, the bag packet is disposed so that the opening of the bags is to and towards the clerk. This enables grasping of the bag at its open top to occur. The bag is pulled away from the packet of bags outwardly so that the sealed bottom of the bag being dispensed eventually moves over the top of the remaining bags in the bag packet.

In grasping of the bag to be dispensed, the clerk grabs the front panel only at the upwardly exposed handle aperture in the front of the bag. The reader will remember that such grabbing will occur at the exterior of the bag. Thus the clerk will be assisted by the outwardly exposed high coefficient of friction of the exterior of the bag surface. Singulation of the bag being grasped easily occurs.

At this point, the front bag panel will begin to be pulled forward. In such a pulling motion, the front panel of the bag being dispensed will slide forward and over to the rear panel of the bag being dispensed. Moreover, as the low coefficient of friction layer of material on the inside front panel of the bag is exposed to the low coefficient of friction material of either the gussets or rear panel of the bag, the sliding of the front panel over the rear panel and gussets will be assisted by the relative low coefficients of friction of the inside surfaces of the bag.

Once this relative sliding motion begins, the central projection connecting the front panel to the bag tab will come under tension. When the tension is sufficient, the central projection will tear. Severing of the central projection will occur.

Successive tearing of each of the projections will follow. The order of tearing from the tabs will be:

1. Central projection at the front panel;
2. Side projection at the side panel;
3. Side projection at the front gusset;
4. Side projection at the rear gusset;
5. Side projection at the rear panel; and,
6. Central projection at the rear panel.

The term "successive" is emphasized. The projections tear—one at a time at each tab. Further as the projections serially tear, they dynamically interact to dispose the bag to the open position. Specifically, the projections tear in sequence about the circumference.

Considering one bag side and one tab only, and remembering that the other bag side and tab act precisely symmetrically, the tearing—and opening—sequence can now be understood. It is sufficient to inform the reader that as tearing of an actual bag from a packet of bags occurs, the sequential parting of the projections can be tactilely perceived and counted. In other words, there is no question that serial severance from the suspending tabs occurs with each projection being serially severed in its turn.

At first the front panel slides out of registry with the gussets and rear panel. Thereafter, the inside projection connecting the front panel to the tab tears. This is followed by the tearing of the outside projection to the tab.

At this point, the front panel of the bag grasped by the clerk is well out ahead of the rear panel, which rear panel remains registered to the remaining bags of the bag packet.

Serially tearing of the projections continues at the outside projections with the projection at the front gusset tearing followed by the projection at the rear gusset and then tearing of the outside gusset at the rear panel.

At this point, it will be noted that the gusset panels and the rear panels are out of registry with the panels of the underlying bag packet. The only portion remaining in registry with the bag packet is the rear panel adjacent the inside gusset. Stated in other terms, the entire bag is being moved away from the rear panel adjacent the open end of the bag. The bag is thus being opened by the natural dispensing action.

Finally, the rear panel at the inside projections are severed. When this occurs, the bag is held by the clerk at the front panel with the rear panel depending downward in a natural open disposition.

Observing the open bag is instructive. The open end or "mouth" of the bag remains in an oval open position relative to the otherwise flat plane of the rest of the bag; the forces of elastic memory or electrostatic forces do not close the bag. Further, the front panel, front gusset, rear gusset, and rear panels are all folded at different angles one to another. This folding provides "origami" like folds to the bag which tend to provide a strong force holding the bag in the open position. As a consequence, merchandise can easily be registered to the elongate, open end of the bag for filling the bag with purchased items for customer transport out of the store.

Two observations relative to the bag filled with merchandise can be made. First, because the high coefficient of friction polymer is shiny, the exterior of the bag sparkles or is highly reflective imparting to the bag an aesthetic sheen. Secondly, since the tab is removed from the upper side portion of the bag, the bag sides do not drape over the imprinted logo to render display of the logo by the bag imperfect. Simply stated, the filled bag presents flat front and rear panels with an advertising display of store logo of the best possible variety.

BRIEF DESCRIPTION OF THE DRAWINGS

FIGS. 5A–5D are a cartoon series of a single bag at the top of the packet of FIG. 1 being dispensed with:

FIG. 5A illustrates the front panel pulled out of registry with respect to the rear packet and with the front inside projections about to be severed;

FIG. 5B illustrates the front panel pulled sufficiently to sever all front panel and gusset projections and about to tear the outside rear panel projections;

FIG. 5C illustrates the front panel pulled sufficiently to sever the rear panel projections;

FIG. 5D illustrates the dispensed bag lying held in the hand of a clerk with the oval and open mouth about to be threaded with a purchased item;

DESCRIPTION OF THE PREFERRED EMBODIMENT

Figure 1:
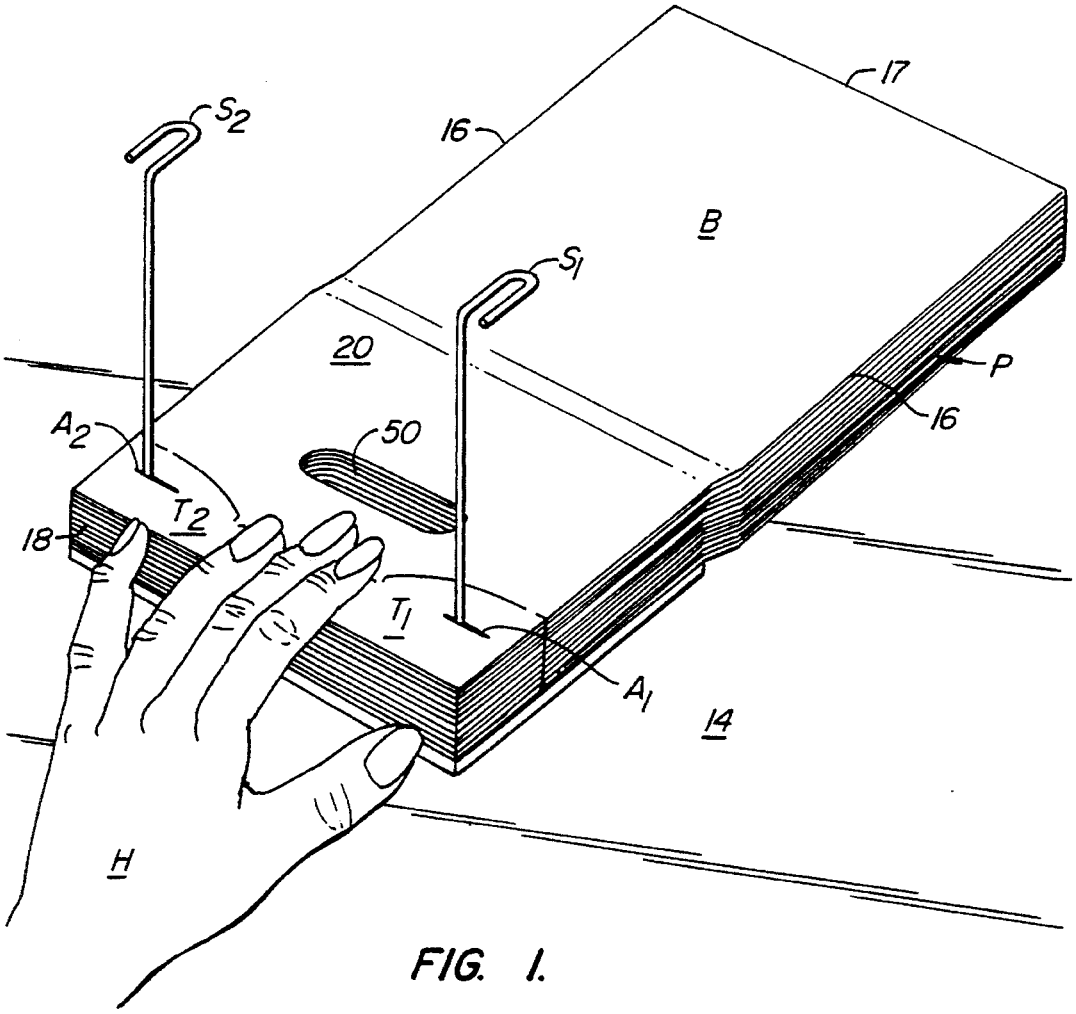
FIG. 1 is a perspective view of a packet of bags constructed in accordance with this invention, the packet illustrating the bags disposed on a horizontal surface with two stanchions registered through common apertures of the dual tabs and illustrating the arm of a clerk about to reach for and dispense the top hag from the packet.

Referring to FIG. 1, a perspective view of packet P of bags B is shown resting on a flat surface 14 from which dispensing occurs. A bag B is exposed at front panel 20 and has sides 16 and sealed bottom 17. The open end 18 is adjacent corner tabs $T_1$ and $T_2$. These respective tabs $T_1$ and $T_2$ define common apertures $A_1$ and $A_2$ through which stanchions $S_1$ and $S_2$ are threaded. It is the purpose of this disclosure to set forth a bag that may be dispensed and opened with a single motion of hand H to handle hole 50 in front bag panel 20. This sequence can be understood visually by referring to FIG. 5A–5D.

Figure 2:
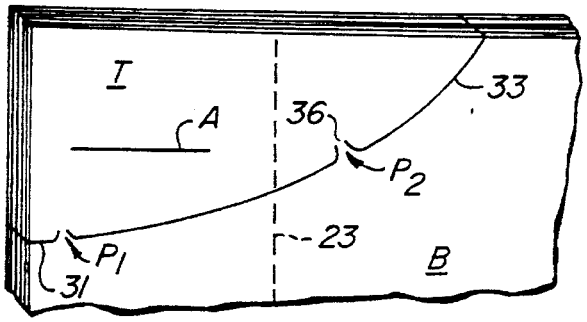
FIG. 2 is a detail at the corner of the bag illustrating tab construction relative to the gusset fold between the front and rear gusset panels and illustrating the placement of the common aperture of the tab out of vertical "zipper tearing" registry of projections.

Referring to FIG. 2, construction of a single tab T may be illustrated, it being remembered that tabs $T_1$ and $T_2$ of FIG. 1 each have the identical construction shown in FIG. 2. Tab T is defined by a first arcuate cut 31, a second arcuate cut 32, and a third arcuate cut 33. Cuts 31 and 32 flare away from the body of bag B leaving a small expanse of unsevered material 34 there between. Similarly, cuts 32 and 33 flare away from the body of bag B leaving a small expanse of unsevered material 36 there between. Both expanses of unsevered material comprises "tits" or projections that point away from the body of bag B to and toward the tabs.

Figure 4:
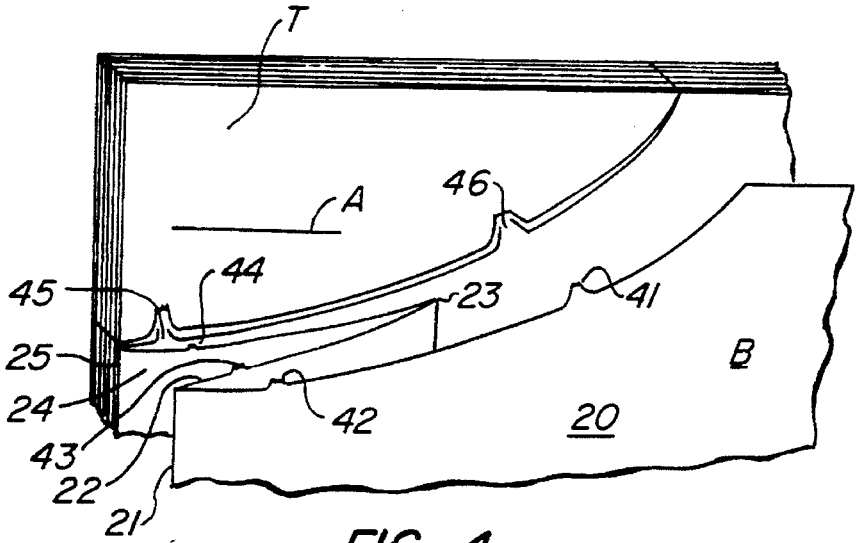
FIG. 4 is an illustration of an open bag on one side only at the front panel, front gusset, rear gusset and rear panel with all projections except the rear panel projections severed from the tabs so that the projections may be clearly identified to the reader.

Referring to FIG. 4, front panel 20 of bag B has been pulled away from tab T. Front panel 20 connects at fold 21 to front gusset 22. Common gusset fold 23 connects front gusset 22 to rear gusset 24. Finally, rear gusset fold 25 connects rear gusset 24 to rear panel 26.

Referring back to FIG. 2, it will be observed that common gusset fold 23 is shown in broken lines. It will be seen that projection $P_1$ overlies the folded gussets and projection $P_2$ overlies the central portion of the bag.

This has an effect on the number of layers of bag material underlying each of the projections $P_1$ and $P_2$. This can best be understood by again referring back to FIG. 4.

Referring back to FIG. 4, the projections on each bag layer can be separately identified and described. Those projections are:

1. Central projection 41 at the front panel 20;
2. Side projection 42 at the front panel 20;
3. Side projection 43 at the front gusset 22;
4. Side projection 44 at the rear gusset 24;
5. Side projection 45 at the rear panel 26; and,
6. Central projection 46 at the rear panel 26.

It will be emphasized hereafter with respect to FIGS. 5A–5D that tearing of the projections actually occurs in the order listed above to open a dispensed bag B.

Figure 3A:
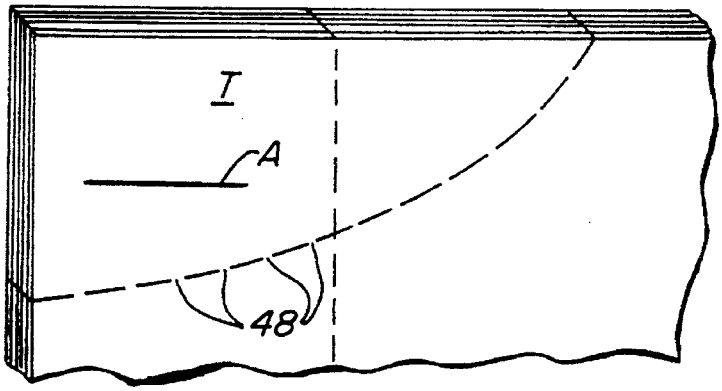
FIG. 3A. PRIOR ART
FIG. 3A is a side elevation of a prior art bag utilizing conventional perforations.
Figure 3B:
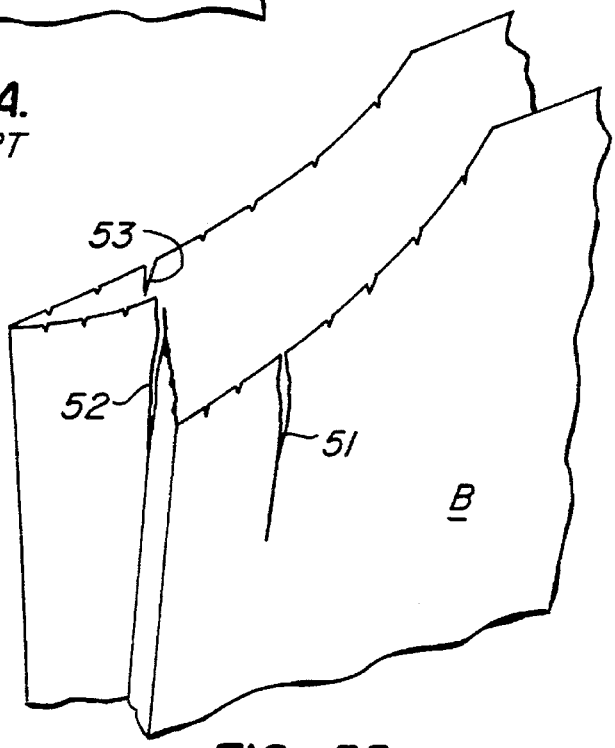
FIG. 3B. PRIOR ART
FIG. 3B illustrates in perspective at an open bag in the gusset fold between the front and rear gusset panels the propagation of tearing down the gusset seam from the construction of the prior art bag of FIG. 3A.

Emphasis has been made that the prior art includes perforations such as perforations 48 shown in tab T of FIG. 3A. It has been found that the perforations 48 register with folds adjacent the gussets (such as 21, 23, 25) and propagate tears 51, 52, 53 when bag B is opened. Consequently, conventional perforations are not used herein. Instead, projections $P_1$, $P_2$ are registered away from and on either side of common gusset fold 23.

Figure 6A:
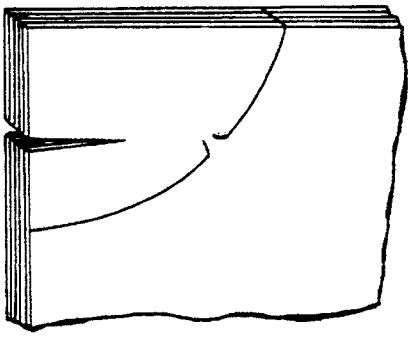
FIGS. 6A and 6B illustrate a common defect encountered in bag production where the tab is out of registry with the gusset sides; this defect is easily identifiable by personnel handling the bag as disclosed in FIG. 6B.
Figure 6B:
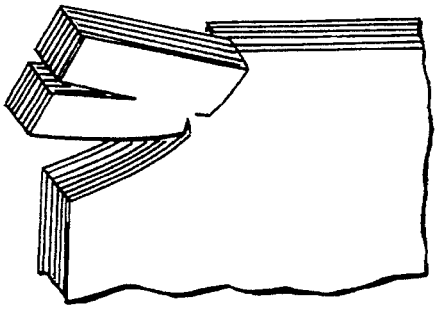

As is conventional in the industry, packet P of bags B are stamped at a common knife apparatus—not shown. Some times the packet P of bags being stacked wanders to one side or the other of bag packet P as shown in FIG. 6A. When this occurs, projections $P_1$ can fall outside of the borders of packet P of bags B. Fortunately, when this occurs, tab T hangs free of packet P as shown in FIG. 6B. This defect is extremely easy to detect on the production line enabling the packet P to be immediately recycled.

Figure 5A:
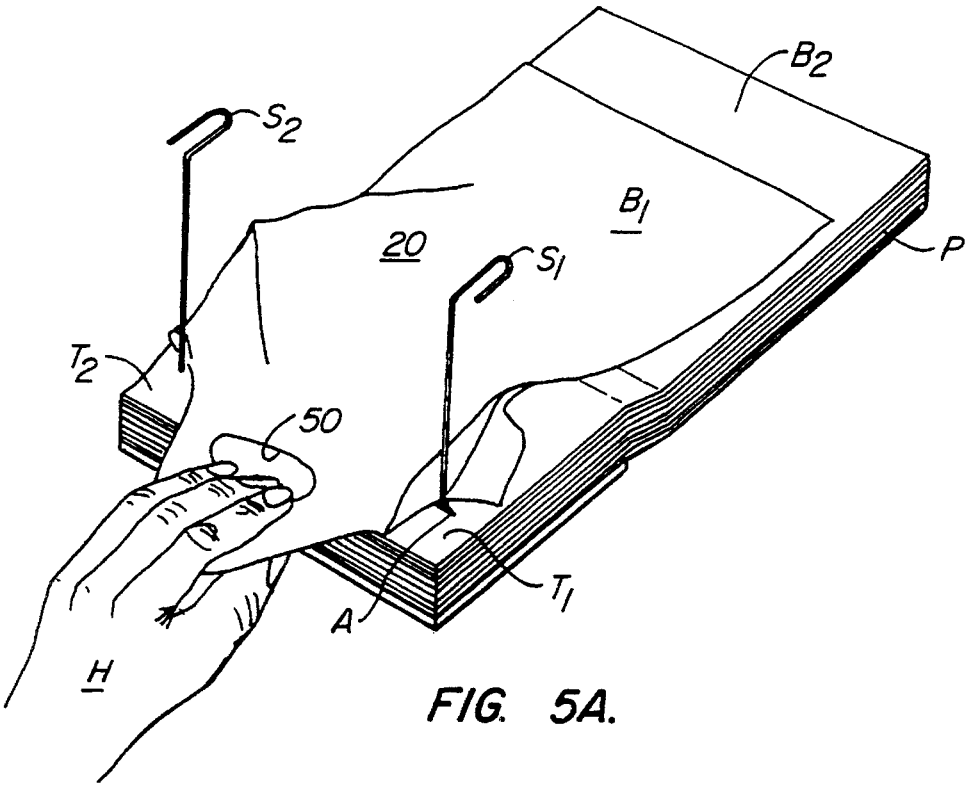

Referring to FIG. 5A and remembering the original illustration of FIG. 1, the dispensing process is outlined. Hand H is shown pulling front panel 20 of bag $B_1$ outwardly and through stanchions $S_1$, $S_2$ which hold tabs $T_1$, $T_2$ at their respective apertures A. Pulling here is illustrated until inside projection 41 on front panel 20 comes under tension (See FIG. 4).

Figure 5B:
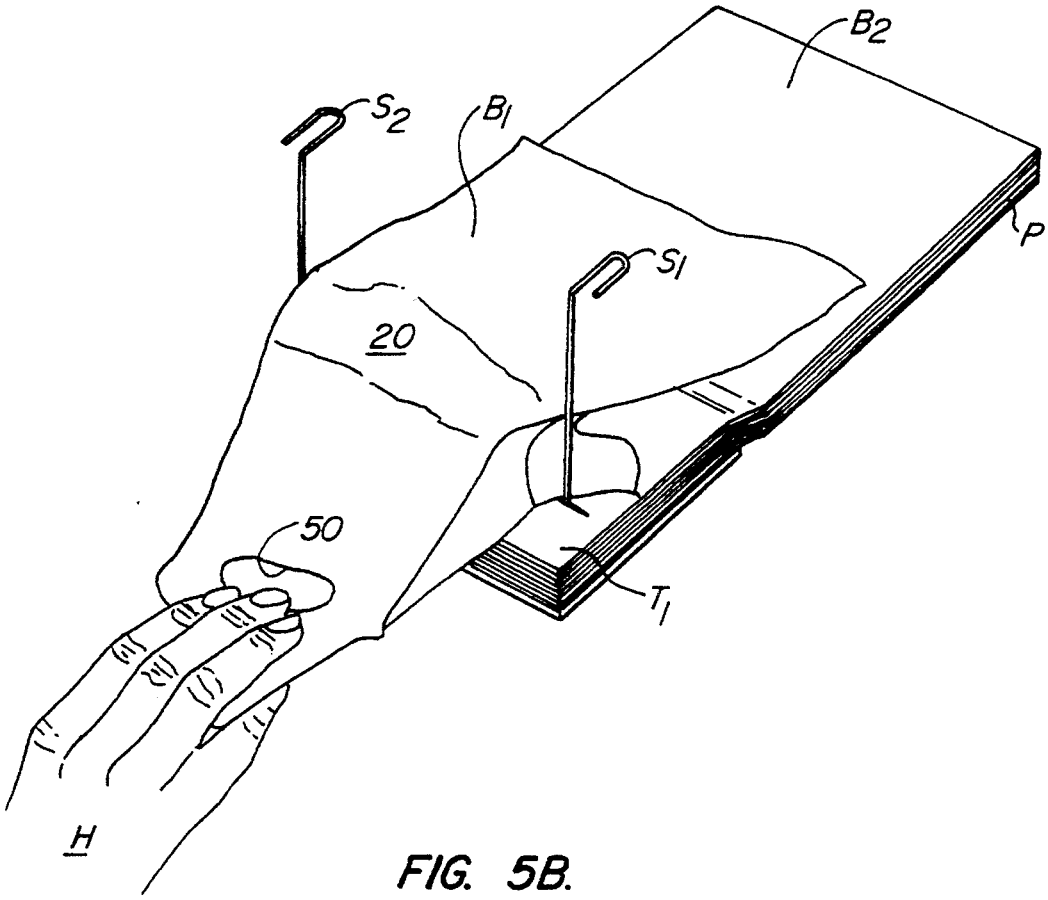
Figure 5C:
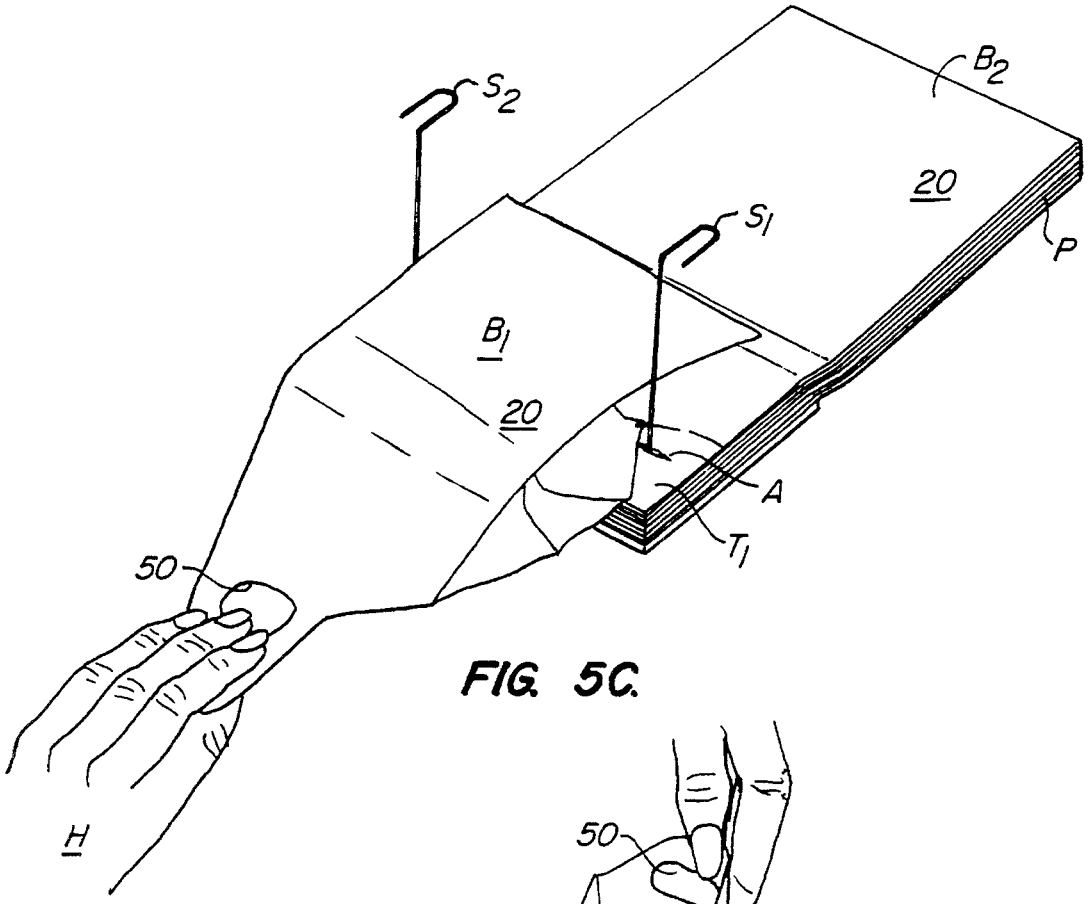

Referring to FIG. 5B, the process of FIG. 5A is shown continuing. Pulling has continued until severing of the outside projections 45 on rear panel 26 is about to occur (See FIG. 4). It can be seen that bag $B_2$, the next in order bag to be dispensed, remains with packet P Referring to FIG. 5C, the process of FIG. 5B is shown continuing. Pulling has continued until severing of inside projections 46 on rear panel 26 is about to occur (See FIG. 4).

Figure 5D:
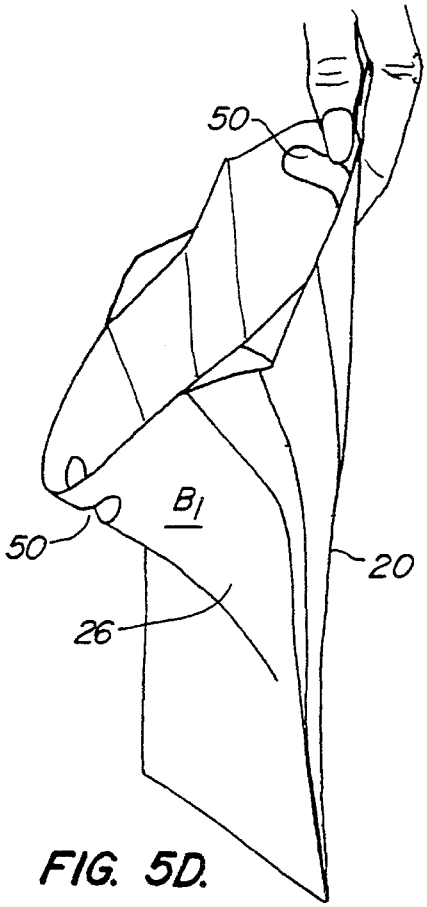

Finally, the bag is shown in FIG. 5D pulled free of packet P. The bag $B_1$ has pendulously depended down from hand H at handle 50 and has rear panel 26 exposed to the viewer It is important to understand that the entire dispensing and opening of the bag is a completely tactile project requiring no visual attention upon the part of the clerk. For example, a bag can easily be singulated and dispensed to the open position and an article placed within the bag while the clerk continues eye contact with the customer. In other words, filling of the bag can occur without the clerk even looking at the bag.

It is to be understood that the projections illustrated thus far are preferred. However, referring to FIGS. 7A and 7B together with FIGS. 8A and 8B, an alternate way of making the projections can be discussed.

Figure 7A:
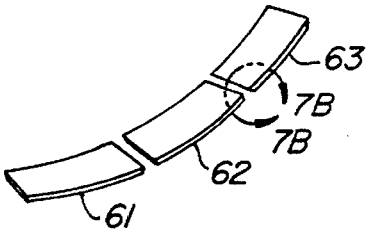
FIGS. 7A and 7B illustrate a knife for cutting an alternative projection to the bag tabs with FIG. 7B being an enlarged view of the knife of FIG. 7A.
Figure 7B:
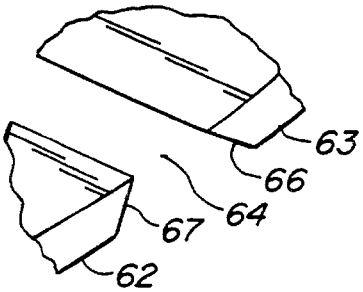
Figure 8A:
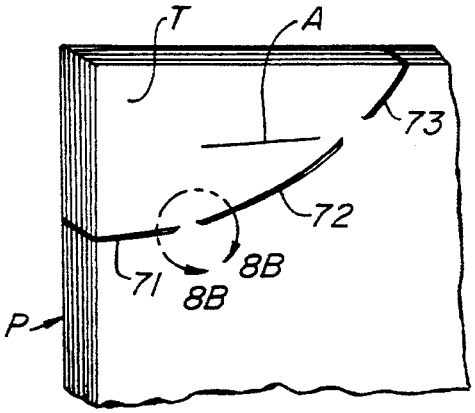
FIGS. 8A and 8B are respective perspective views of a bag packet at the tab after the tab has been defined by the knife of FIGS. 7A and 7B, it being noted that FIG. 8B is an enlarged view of the outside projection shown in FIG. 8A; and, FIG. 9 illustrates the top of the front panel, front and rear gussets, and rear panel, it being noted that the bag of FIGS. 8A and 8B produces at the severed gussets a more uniform border than that shown in FIG. 4.
Figure 8B:
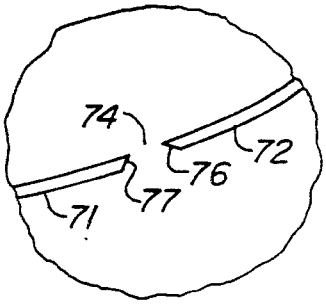
Figure 9:
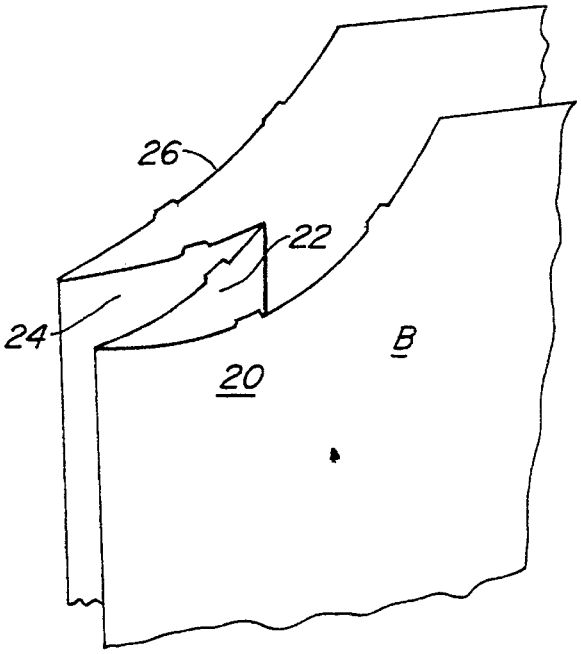

FIGS. 7A and 7B disclose a knife in three sections 61, 62, 63 for making the arcuate cuts 71, 72, 73 shown in FIGS. 8A and 8B. The knife is shown only at the blades; relative bracing of the blades is conventional and therefore not shown. Referring to FIG. 7B, it will be seen that knives 62, 63 have tapered ends 66, 67, forming projection sides 76, 77 (See FIG. 8B). Such a configuration of the projections will leave a smoother border at the bag top as illustrated in the view of FIG. 9 at panels 20–26. A more aesthetic appearance results.

We have mentioned the preferred use of co-extruded material. We preferred two layers of high density polyethylene comprising 90% of the weight of the bag on the inside surfaces of the bag and a layer of 10% low density polyethylene on the outside of the bag (as those terms are understood in our industry). Depending upon the ultimate use of the bags, thicknesses across the total bag panels and gussets can vary depending upon the overall strength of the bag required.

Those having skill in the art will realize that the concept here illustrated will work on a bag without gusset folds. Further, it is possible to have tabs without apertures. Any expedient that will hold the tabs will suffice. For example, although FIGS. 7A and 7B illustrate a knife, paper formed in the shape of the knives could effect holding of tabs T. Further, it is not required that tabs T be at the corners.

Additionally, I have indicated handle holes H in the respective front panel 20 and rear panel 26. These handle holes are not required, particularly in the case of small bags.

What is claimed is:

1. In a packet containing a plurality of dual tab plastic merchandising bags, each said bag including, a front panel, a rear panel, each side of said bag between said front and rear panels including, a front gusset folded from said front panel, a rear gusset folded from said rear panel, said front and rear gussets joined at a common gusset fold to form an endless tube of bag material around the periphery of said bag, said bags being sealed and severed at the bottom and open and severed at the top, said bags collapsed and folded one on another so that said gusset sides are folded upon themselves and collapsed under and between the bag front and rear panels, said front and rear gussets extending partially the width of the front and rear panels of said bag so as to define at the side edge of the bag four overlying bag layers stacked one upon another, said layers including said front panel, said front gusset, said rear gusset, and said rear panel and to define between said gussets at the central portion of said bag two overlying bag layers stacked upon one another, said two layers including said front panel and rear panels, handle holes provided centrally of said front and rear panels adjacent said open top of the bag;

first and second tabs of such bags adjacent the sides at said top of the bag, said tabs having a first portion overlying said gussets and a second portion overlying said central portion of said bag between said gussets, said tabs fused together to form said packet of bags registered at least at said front and rear panels;

means mounting said packet of bags at said tabs for dispensing said bags;

the improvement to said tabs comprising in combination:

side and center projections, said side projections defined over said front panel, said front gusset, said rear gusset and said rear panel, said center projections defined over said front panel and said rear panel;

said projections each formed by paired cuts separating the body of the bag from tabs, said cuts being arcuate and spaced apart one from another at their respective ends to form between the tabs and the body of the bag severed borders that point away from the body of the bag and to or toward the material of the tab;

said cuts defining therebetween a small and un-severed section of bag material left in place to form the material bridge which joins the body of the bag to the tab until the bag is severed, the un-severed section of bag material being so formed that when said front panel of said bag is pulled over said rear panel of said bag upwardly to and toward said opening of said bag said bag is singulated and dispensed in an open disposition from said tabs.

2. The packet of claim 1 and including:

a common aperture through the center of each of the tabs of said bags from which the bags as a group can be inserted to a member extending through said bags substantially normal to the front and rear panels of said bags;

said common aperture defined vertically inside of each said projection whereby vertical tears from said projections in the material of said tabs does not propagate to said common aperture of said tabs.

3. The packet of claim 1 and wherein the material of said bags is co-extruded having a material with a high coefficient of friction on the exterior of said bags and material of a relatively lower coefficient of friction on the interior of said bags.

4. In a packet containing a plurality of dual tab plastic merchandising bags each said bag including, a front panel, a rear panel, each side of said bag between said front and rear panels including, a front gusset folded from said front panel, a rear gusset folded from said rear panel, said front and rear gussets joined at a common gusset fold to form an endless tube of bag material around the periphery of said bag, said bags being sealed and severed at the bottom and open and severed at the top, said bags collapsed and folded one on another so that said gusset sides are folded upon themselves and collapsed under and between the bag front and rear panels, said front and rear gussets extending partially the width of the front and rear panels of said bag so as to define at the side edge of the bag four overlying bag layers stacked one upon another, said layers including said front panel, said front gusset, said rear gusset, and said rear panel and to define between said gussets at the central portion of said bag two overlying bag layers stacked upon one another, said two layers including said front panel and rear panels, handle holes provided centrally of said front and rear panels adjacent said open top of the bag;

first and second tabs of such bags adjacent the sides at said top of the bag, said tabs having a first portion overlying said gussets and a second portion overlying said central portion of said bag between said gussets, said tabs fused together to form said packet of bags registered at least at said front and rear panels;

a common aperture through the center of each of the tabs of said bags from which the bags as a group can be inserted to a member extending through said bags substantially normal to the front and rear panels of said bags;

means mounting said packet of bags at said tabs for dispensing said bags;

the improvement to said tabs and common apertures comprising in combination:

side and center projections, said side projections defined over said front panel, said front gusset, said rear gusset and said rear panel, said center projections defined over said front panel and said rear panel;

said projections each formed by paired cuts separating the body of the bag from tabs, said cuts being arcuate and spaced apart one from another at their respective ends to form between the tabs and the body of the bag severed borders that point away from the body of the bag and to or toward the material of the tab;

said cuts defining therebetween a small and un-severed section of bag material left in place to form the material bridge which joins the body of the bag to the tab until the bag is severed;

said common aperture defined vertically inside of each said projection so that vertical tears from said projections in the material of said tabs do not propagate to said common aperture of said tabs, the un-severed section of bag material being so formed that when said front panel of said bag is pulled over said rear panel of said bag upwardly to and toward said opening of said bag, said bag is singulated and dispensed in an open disposition from said tabs. together to form said packet of bags registered at least at said front and rear panels;

a common aperture through the center of each of the tabs of said bags from which the bags as a group can be inserted to a member extending through said bags substantially normal to the front and rear panels of said bags;

means mounting said packet of bags at said tabs for dispensing said bags;

the improvement to said tabs and common apertures comprising in combination:

side and center projections, said side projections defined over said front panel, said front gusset, said rear gusset and said rear panel, said center projections defined over said front panel and said rear panel;

said projections each formed by paired cuts separating the body of the bag from tabs, said cuts being arcuate and spaced apart one from another at their respective ends to form between the tabs and the body of the bag severed borders that point away from the body of the bag and to or toward the material of the tab;

said cuts defining therebetween a small and un-severed section of bag material left in place to form the material bridge which joins the body of the bag to the tab until the bag is severed;

said common aperture defined vertically inside of each said projection so that vertical tears from said projections in the material of said tabs do not propagate to said common aperture of said tabs, the un-severed section of bag material being so formed that when said front panel of said bag is pulled over said rear panel of said bag upwardly to and toward said opening of said bag, said bag is singulated and dispensed in an open disposition from said tabs.

5. The packet of claim 4 and wherein the material of said bags is co-extruded having a material with a high coefficient of friction on the exterior of said bags and material of a relatively lower coefficient of friction on the interior of said bags.

6. In a packet containing a plurality of dual tab plastic merchandising bags each said bag including, a front panel, a rear panel, each side of said bag between said front and rear panels including, a front gusset folded from said front panel, a rear gusset folded from said rear panel, said front and rear gussets joined at a common gusset fold to form an endless tube of bag material around the periphery of said bag, said bags being sealed and severed at the bottom and open and severed at the top, handle holes provided centrally of said front and rear panels adjacent said open top of the bag;

means mounting said packet of bags at said tabs for dispensing said bags;

first and second tabs of such bags adjacent the sides at said top of the bag, the improvement to said tabs comprising in combination:

a plurality of projections, said projections each formed by paired cuts separating the body of the bag from tabs, said cuts being arcuate and spaced apart one from another at their respective ends to form between the tabs and the body of the bag severed borders that point away from the body of the bag and to or toward the material of the tab;

said cuts defining therebetween a small and un-severed section of bag material left in place to form the material bridge which joins the body of the bag to the tab until the bag is severed, the un-severed section of bag material being so formed that when said front panel of said bag is pulled over said rear panel of said bag upwardly to and toward said opening of said bag said bag is singulated and dispensed in an open disposition from said tabs.

7. The packet of claim 6 and including:

a common aperture through the center of each of the tabs of said bags from which the bags as a group can be inserted to a member extending through said bags substantially normal to the front and rear panels of said bags;

said common aperture defined vertically inside of each said projection whereby vertical tears from said projections in the material of said tabs does not propagate to said common aperture of said tabs.

8. The packet of claim 6 and wherein the material of said bags is co-extruded having a material with a high coefficient of friction on the exterior of said bags and material of a relatively lower coefficient of friction on the interior of said bags.

9. In a packet containing a plurality of dual tab plastic merchandising bags each said bag including, a front panel, a rear panel joined to said front panel to form a continuous tube, said bags being sealed and severed at the bottom and open and severed at the top, handle holes provided centrally of said front and rear panels adjacent said open top of the bag;

first and second tabs of such bags adjacent the sides at said top of the bag, and means mounting said packet of bags at said tabs for dispensing said bags;

the improvement to said tabs comprising in combination:

a plurality of projections, said projections each formed by paired cuts separating the body of the bag from tabs, said cuts being arcuate and spaced apart one from another at their respective ends to form between the tabs and the body of the bag severed borders that point away from the body of the bag and to or toward the material of the tab;

said cuts defining therebetween a small and un-severed section of bag material left in place to form the material bridge which joins the body of the bag to the tab until the bag is severed, the un-severed section of bag material being so formed that when said front panel of said bag is pulled over said rear panel of said bag upwardly to and toward said opening of said bag said bag is singulated and dispensed in an open disposition from said tabs.

10. The packet of claim 9 and wherein the material of said bags is co-extruded having a material with a high coefficient of friction on the exterior of said bags and material of a relatively lower coefficient of friction on the interior of said bags.

11. The packet of claim 9 and wherein said bag includes folded gussets.

12. In a packet containing a plurality of dual tab plastic merchandising bags each said bag including, a front panel, a rear panel joined to said front panel to form a continuous tube, said bags being sealed and severed at the bottom and open and severed at the top, first and second tabs of such bags adjacent the sides at said top of the bag, means mounting said packet of bags at said tabs for dispensing said bags;

the improvement to said tabs comprising in combination:

a plurality of projections, said projections each formed by paired cuts separating the body of the bag from tabs, said cuts being arcuate and spaced apart one from another at their respective ends to form between the tabs and the body of the bag severed borders that point away from the body of the bag and to or toward the material of the tab;

said cuts defining therebetween a small and un-severed section of bag material left in place to form the material bridge which joins the body of the bag to the tab until the bag is severed, the un-severed section of bag material being so formed that when said front panel of said bag is pulled over said rear panel of said bag upwardly to and toward said opening of said bag said bag is singulated and dispensed in an open disposition from said tabs.

13. The invention of claim 12 and including:

handle holes provided centrally of said front and rear panels adjacent said open top of the bag.

* * * * *